US005265441A

United States Patent [19]

Kramer et al.

[11] Patent Number: 5,265,441

[45] Date of Patent: Nov. 30, 1993

[54] DEVICE FOR COOLING A LAMINAR MATERIAL, MORE PARTICULARLY A METAL STRIP

[75] Inventors: Carl Kramer; Bernd Konrath, both of Aachen; Bernd Berger, Kaarst; Peter Reinthal, Hemer, all of Fed. Rep. of Germany

[73] Assignee: Sundwiger Eisenhutte Maschinenfabrik GmbH & Co., Hemer-Sundwig, Fed. Rep. of Germany

[21] Appl. No.: 878,868

[22] Filed: May 5, 1992

[30] Foreign Application Priority Data

May 16, 1991 [DE] Fed. Rep. of Germany ..... 4116019

[51] Int. Cl.[5] ..... F25D 17/02

[52] U.S. Cl. ..... 62/374; 62/63

[58] Field of Search ..... 62/63, 374

[56] References Cited

U.S. PATENT DOCUMENTS

| | | | |
|---|---|---|---|
| 1,998,192 | 4/1935 | Haswell | 266/6 |
| 3,687,145 | 8/1972 | Schrader et al. | 134/114 |
| 4,000,625 | 1/1977 | Beerens et al. | 62/63 |
| 4,497,180 | 2/1985 | Graham | 62/374 |
| 4,974,424 | 12/1990 | Tosaka et al. | 62/373 |

FOREIGN PATENT DOCUMENTS

| | | | |
|---|---|---|---|
| 56-020126 | 2/1981 | Japan . | |
| 137111 | 8/1984 | Japan | 62/374 |
| 144513 | 8/1984 | Japan | 62/374 |

OTHER PUBLICATIONS

"Zur Kuhleffizienz laminar-orthogonaler . . . Warmbandstrassen" Stahl. u. Eisen 104 (1984) No. 21, Oct. 15, 1984.

A. Sigalla, "The Cooling of Hot Steel Strip With Water Jets" Journal of the Iron and Steel Institute, May 1957, pp. 90–93.

F. Kohring, "Waterwall water-cooling systems", Iron and Steel Engineer, Jun. 1985, pp. 30–36.

Y. Miyake et al, "Device and System for Controlled Cooling for Hot Strip Mill", Kawasaki Steel Technical Report (1978), pp. 496–503.

*Primary Examiner*—Ronald C. Capossela

*Attorney, Agent, or Firm*—Meltzer, Lippe, Goldstein, Wolf, Schlissel & Sazer

[57] ABSTRACT

The invention relates to a device for cooling a laminar material, more particularly a metal strip 2, by liquid nozzles 11*a*, 11*b*, 12*a*, 12*b* disposed on both sides. The liquid nozzles 11*a*, 11*b*, 12*a*, 12*b* take the form of full-jet nozzles and so act upon the surface of the material 2 to be cooled by rebounding jets that zones of shooting flow SS are formed around the point of impingement of the individual rebounding jets.

8 Claims, 5 Drawing Sheets

DEVICE FOR COOLING A LAMINAR MATERIAL, MORE PARTICULARLY A METAL STRIP

Figure 1:
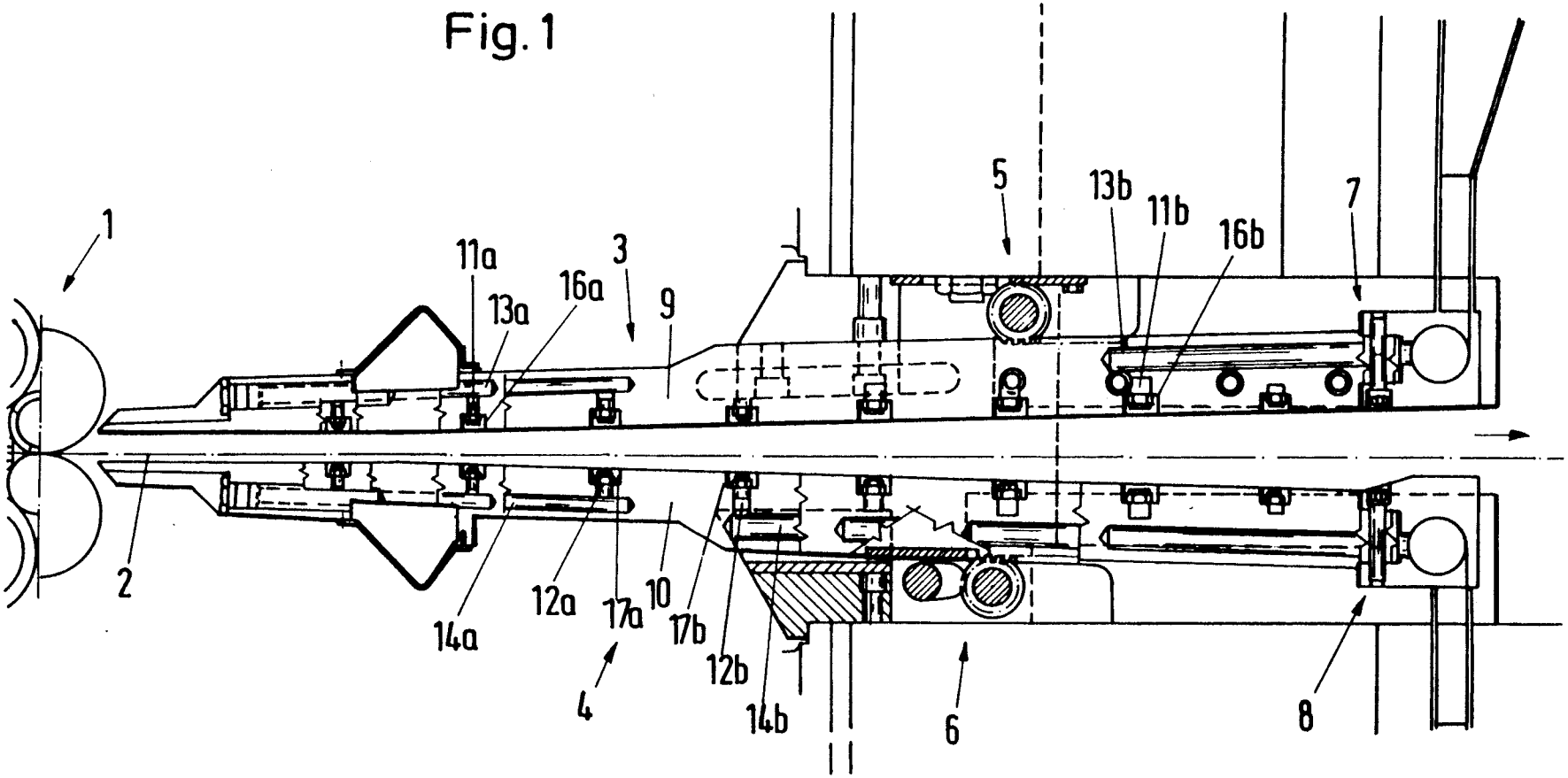

The invention relates to a device for cooling a laminar material, more particularly a metal strip, by liquid nozzles disposed on both sides.

In many fields of technology, more particularly in the processing of semi-finished products in the metal industry, it is a problem to cool a laminar material such as, for example, a metal strip or a metal sheet, as intensively as possible by the application of a cooling liquid. Water is used as a cooling liquid, for example, in the light metal industry in the hardening and tempering of strips and sheets of light metal alloys. In the rolling of strips of light metal alloys, heavy metal alloys or steel, the cooling liquid used is either rolling oil or a rolling emulsion. To achieve as satisfactory cooling effect as possible, in one prior art device large volumetric flows of cooling agent are applied to the strip at high pressure by means of a maximum of three rows of flat-sectioned jet nozzles disposed transversely of the direction of strip travel. However, the cooling effect thereby achieved is inadequate to meet present-day demands for as high performances as possible in the rolling of strips. It is true that investigations have shown that the cooling effect can be improved with higher pressures, but the minimum nozzle diameter which must be maintained to prevent dirtying also causes a very high volumetric flow which calls for considerable driving powers to supply the cooling liquid.

It is an object of the invention to provide a device for the cooling of a laminar material by means of which an appreciably higher cooling effect can be achieved than with the prior art flat-section jet nozzles, accompanied by a comparatively low power for the supply of the cooling liquid.

This problem is solved in a device of the kind specified by the features that the liquid nozzles are full-jet nozzles whose pressure and nozzle diameter are each so adapted to their distance from the surface of the strip to be cooled and the thickness of the liquid layer forming on the surface that a zone of shooting flow is formed around the point of impingement of the particular rebounding jet.

In the device according to the invention the full jets of liquid impinge at the velocity with which they emerge from the nozzles in the form of rebounding jets on the surface of the material to be cooled, where they are deflected, a zone of shooting flow being set up due to the high tangential velocity. Due to the high velocity of flow in that zone the cooling effect is extraordinarily high, since with a shooting flow the velocity of flow is higher than the velocity of propagation of the waves. The greater height of the liquid layer building up due to the low velocity of flow can, therefore, since said height of layer runs like a wave towards the shooting flow, be set up only at a place where the velocity of the shooting flow has dropped below the velocity of propagation of the waves. By suitable adjustment of the nozzle pressure, nozzle diameter and the distance of the nozzle from the surface of the material to be cooled, therefore, it is possible to determine the required size of the zone of shooting flow. The formation of a zone with shooting flow is a peculiarity which occurs only in the case of a liquid flow with a boundary surface to the surrounding gas space. Comparative investigations as between the device according to the invention and a device with flat-section jet nozzles have shown that although there is an appreciably better heat transfer of the liquid jets of the flat-section jet nozzles at the places of impingement in comparison with the places of impingement of the jets from the full-jet nozzles, the cooling effect according to the invention was better by 30%, referred to the total surface of the material to be cooled.

Advantageous embodiments of the invention are described below.

Figure 2:
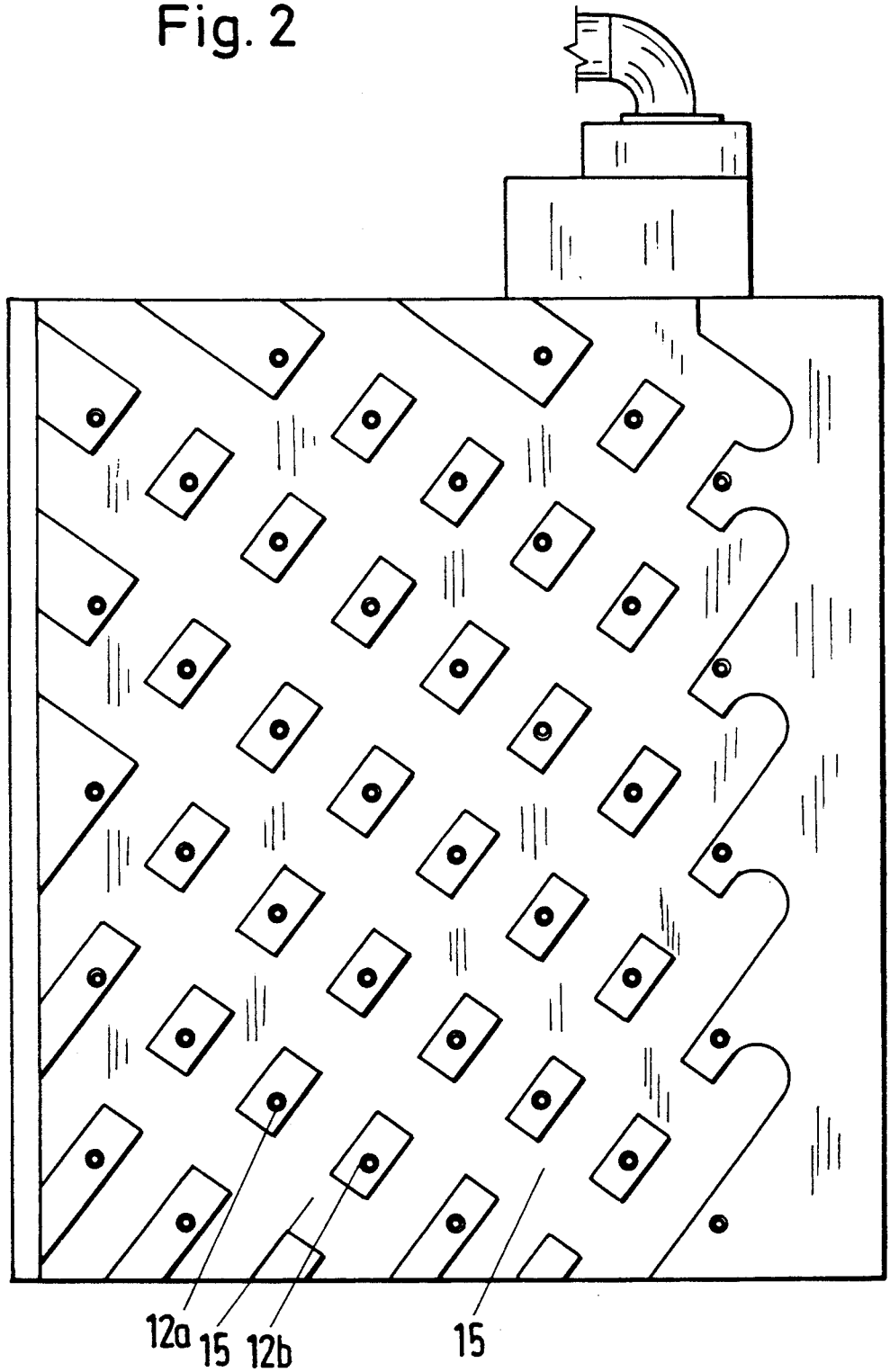
Figure 3:
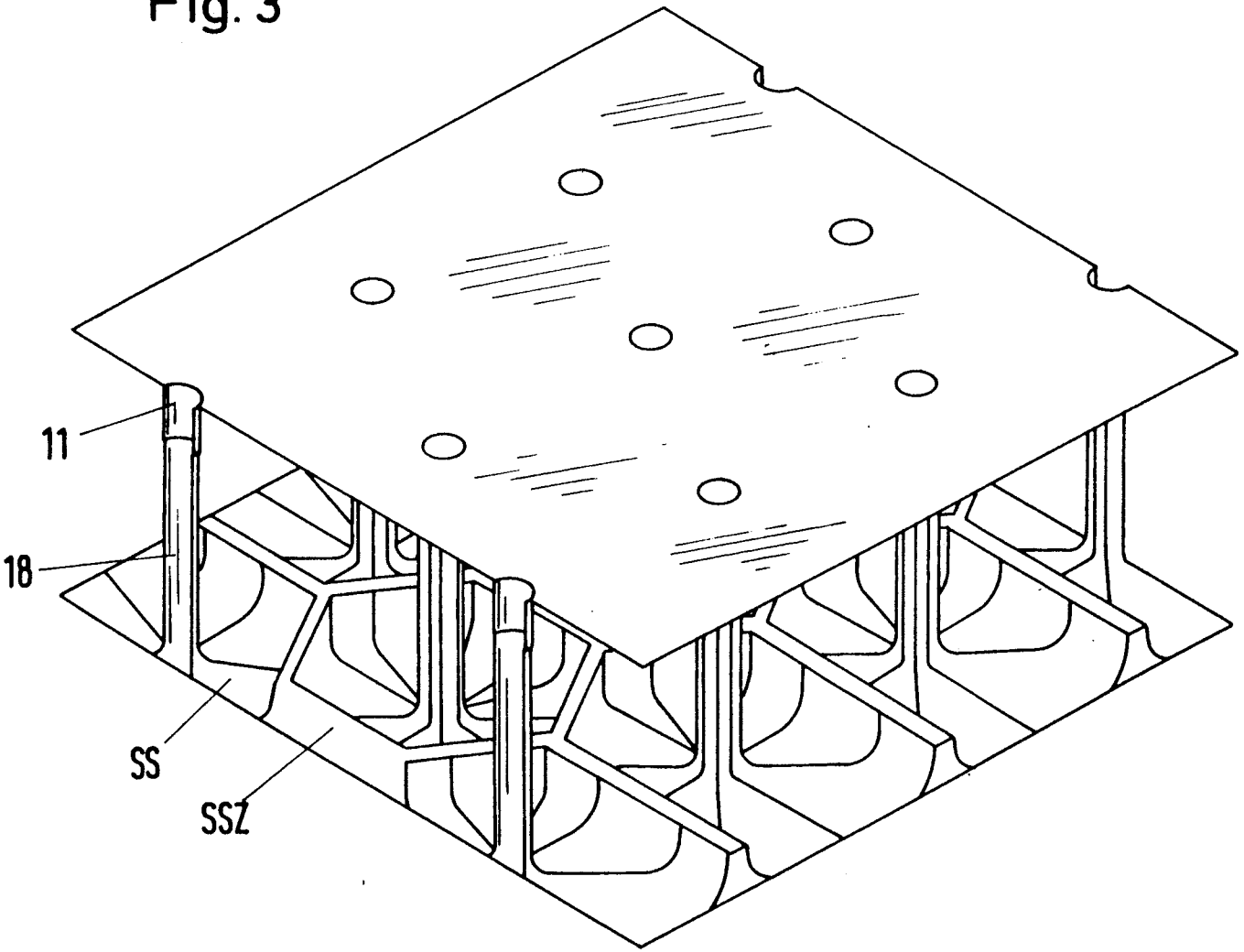
Figure 4:
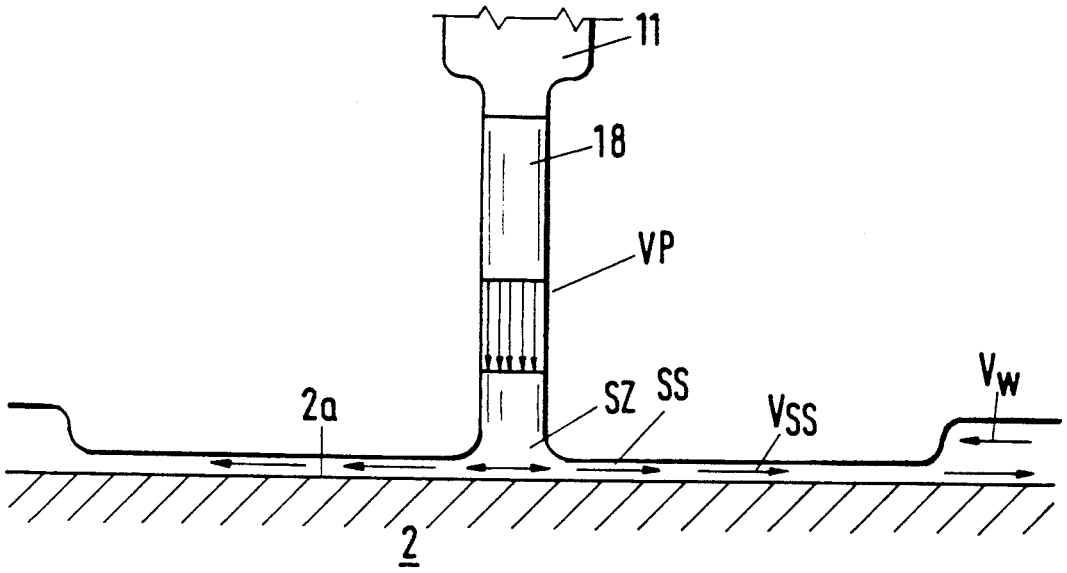
Figure 5:
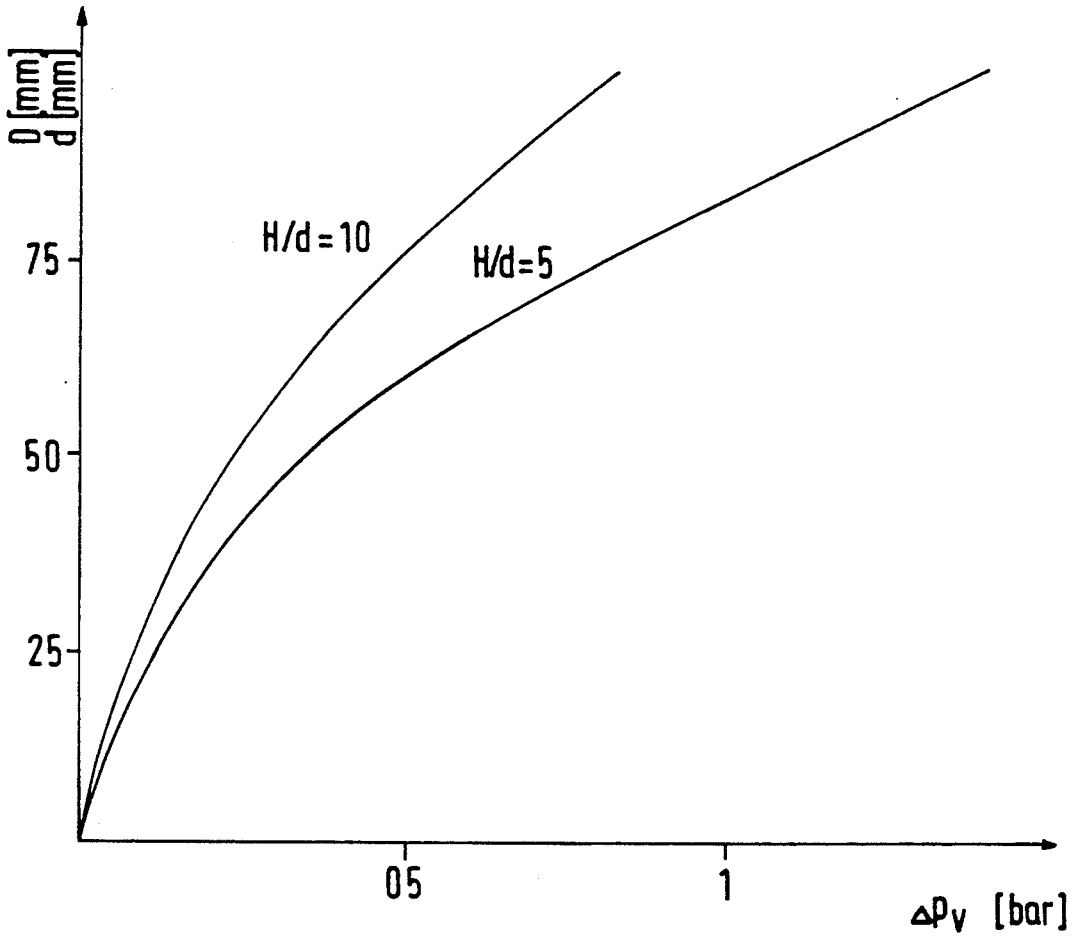

The invention will be explained in greater detail hereinafter with reference to drawings showing as a typical application a device for the cooling of a metal strip to be rolled in a roll stand. In the drawings:

FIG. 1 is a side elevation of a device for cooling the metal strip which is disposed at the top and bottom sides of the strip on the outlet side of a rolling mill, FIG. 2 is an elevation of a device disposed on the underside of the metal strip for the cooling thereof as shown in FIG. 1, FIG. 3 is a diagrammatic perspective view of the top side device for cooling the metal strip as shown in FIG. 1, with full jets of liquid and a flow area on the surface of a strip to be cooled, FIG. 4 is a sectional view of a full-jet nozzle with a full jet of liquid and shooting flow on the surface of the strip to be cooled, and FIG. 5 is a graph of the ratio between the diameter of the zone with shooting flow and the nozzle diameter in dependence on the pressure of the full jet of liquid, with different ratios of the distance between the nozzle and the surface of the strip to be cooled and of the nozzle diameter.

Referring to FIG. 1, a device 3, 4 for cooling a metal strip 2 is disposed in the outlet zone of a roll stand 1 on both sides of said metal strip 2, which is horizontally guided out of the roll stand. The two devices 3, 4 can be displaced in the direction in which the strip travels by means 5–8 only outlined in the drawings, to enable the distance between the devices 3, 4 and the roll stand 1 and/or the metal strip 2 to be adjusted.

The main component of each device 3, 4 is a plate 9, 10 equipped with a plurality of full-jet nozzles 11*a*, 11*b*, 12*a*, 12*b*, which are supplied with a cooling liquid via ducts 13*a*, 13*b*, 14*a*, 14*b* disposed in the plates 9, 10 and from which the full jet of liquid emerges in the form of a rebounding jet perpendicularly on to the surfaces of the metal strip 2. The plates 9, 10 are so designed as to perform the function of the stable guide plates otherwise required. The full-jet nozzles 13*a*, 13*b*, 14*a*, 14*b* are disposed regularly distributed in the plate 9, 10, more particularly at the corners of successively disposed rectangles, more particularly squares or triangles, so as to form discharge channels between themselves. In the bottom plate to facilitate the discharge of the cooling liquid the zone between the nozzles is formed with discharge channels taking the form of groove-like depressions 15. More particularly in the case of large working widths it may be advantageous to construct the discharge channels with a cross-section which increases from the centre towards the edge. For certain portions of the length this increase in cross-section can take place in stages or continuously. As FIG. 1 shows, the full-jet nozzles 11*a*, 11*b*, 12*a*, 12*b* are inserted in countersinkings 16*a*, 16*b*, 17*a*, 17*b*, so that they are set back by their end faces in relation to the surface of the plate 9, 10 and are thereby protected against damage by contacting the strip. FIG. 1 also shows how in the direction in which the strip travels the distance between the nozzles 11*a*, 11*b*, 12*a*, 12*b* and the metal strip 2 increases and the nozzle cross-section becomes larger.

When rebounding jets 18 emerge from the full-jet nozzles 11 and impinge perpendicularly on the surface of the metal strip 2, a flow area as shown in FIG. 3 is formed on the surface of the metal strip 2. As indicated in FIG. 4, the velocity profile VP of the rebounding jet 18 does not change from its emergence from the nozzle 11 until it impinges on the surface 2*a* of the metal strip 2 to be cooled, since due to the considerable difference in density from the surrounding air, practically no mixing of the cooling liquid therewith takes place. Similarly, during radial discharge from the damming zone SZ in the zone of the point where the jet impinges the spreading out of the liquid flow on the surface 2*a* is not noticeably affected by mixing with the surrounding air. For this reason a shooting flow SS can be formed on the surface 2*a* as long as the flow of cooling liquid has not yet been decelerated by the effect of friction on the surface at a velocity $V_{SS}$ which is lower than the velocity of propagation $V_w$ of a wave in the opposite direction.

FIG. 5 shows quantitatively the connection between the diameter of the zone of shooting flow SS and the nozzle diameter d and also between the distance H of the nozzle 11 and the surface 2*a* from the strip 2 to be cooled. Desirably, the ratio of the nozzle diameter d to the nozzle distance H is in the range of 8 to 30. The height of the wave of liquid which forms at the end of the zone of shooting flow has the reference $h_w$.

As shown in FIG. 3, a zone of shooting flow SS forms around the point of impingement of each rebounding jet 18—i.e., around the primary damming zone. Between the difference zones a secondary damming zone SSZ forms where the shooting flows impinge on one another and are deflected perpendicularly by the surface 2*a*. Via the secondary damming zones SSZ the cooling liquid flows away to the edges. To prevent the cooling liquid flowing out of the secondary damming zone back to the lower plate 10 from impeding the rebounding jets 18 emerging from the nozzles 12*a*, 12*b*, the lower plate 10 is formed, as described, with the discharge channels 15 open in the direction of the edges of the plate 10. Corresponding steps need not be taken in the case of the upper plate 9, since here the cooling liquid can flow away directly to the lateral edges via the secondary damming zones SSZ forming on the surface of the metal strip 2.

The advantages achieved by the invention consist in the improved cooling effect. This again makes possible operations with a higher throughput in the case of metal strip to be rolled. The costs of the improved cooling are negligibly low, since the stable guide plates 9, 10 in any case used can be correspondingly redesigned to accommodate the full-jet nozzles 11*a*, 11*b*, 12*a*, 12*b*, or the special plates can also take over the function of the guide plates otherwise required.

We claim:

1. A device for cooling a metal strip having an upper side and a lower side, comprising a plurality of individual liquid nozzles of circular cross-section disposed opposite said upper and lower sides of said metal strip which dispense individual jets of liquid of circular cross-section under pressure against said upper and lower sides to form liquid layers on said upper and lower sides, the diameter of said nozzles and the nozzle pressure with which said individual jets are dispensed against said upper and lower sides being adapted to the distance of said nozzles from said upper and lower sides and to the thickness of said liquid layers so that a zone of shooting flow of circular cross-section is formed around each point of impingement associated with each of said nozzles.

2. The device of claim 1 wherein said liquid nozzles are disposed at corner points of successively disposed rectangles.

3. The device of claim 1 wherein said liquid nozzles are disposed at corner points of successively disposed squares.

4. The device of claim 1 wherein said liquid nozzles are disposed at corner points of successively disposed equilateral triangles.

5. The device of claim 1 wherein the ratio of the nozzle diameter to the nozzle distance is in the range of 8 to 30.

6. The device of claim 1 wherein said liquid nozzles disposed opposite said upper side are contained in an upper plate spaced apart from said upper side, and said liquid nozzles disposed opposite said lower side are contained in a lower plate spaced apart from said lower side, said lower plate including discharge channels for receiving liquid which accumulates in secondary damming zones formed on said lower side of said metal strip.

7. The device of claim 1 wherein the diameter of said nozzles increases along a direction of travel of said metal strip.

8. The device of claim 1 wherein the distance of said nozzles from said upper and lower sides increases along a direction of travel of said metal strip.

* * * * *